United States Patent [19]

Demars et al.

[11] Patent Number: 4,852,219

[45] Date of Patent: Aug. 1, 1989

[54] FORMATION OF MINERAL FIBRE FLAKES AND USE OF THESE FLAKES TO RECONSTITUTE INSULATING MATS

[75] Inventors: Yves Demars, Clermont; Francois Szalata, Rantigny; Christian DeCoopman, St-Just-En-Chaussee, all of France

[73] Assignee: Isover Saint-Gobain, Courbevoie, France

[21] Appl. No.: 55,888

[22] Filed: Jun. 1, 1987

[51] Int. Cl.[4] ..... D01G 25/00

[52] U.S. Cl. ..... 19/305; 19/296

[58] Field of Search ..... 19/296, 305, 304

[56] References Cited

U.S. PATENT DOCUMENTS

| | | | |
|---|---|---|---|
| 2,023,273 | 12/1935 | Leguillon | 19/296 X |
| 2,711,381 | 6/1955 | Novotny et al. | 19/304 V |
| 3,087,203 | 4/1963 | Pearson | 19/305 X |
| 3,140,220 | 8/1967 | Walter | 428/126 |
| 3,177,275 | 4/1965 | Brenner | 19/305 X |
| 3,252,186 | 5/1966 | Oja | 19/305 X |
| 3,332,114 | 7/1967 | Oja | 19/303 |
| 4,097,209 | 6/1978 | Garrick et al. | 19/305 X |
| 4,106,163 | 8/1978 | Desverchere | 19/296 |
| 4,123,211 | 1/1979 | Rudloff | 425/82.1 |
| 4,494,919 | 1/1985 | Knudson et al. | 19/296 X |

FOREIGN PATENT DOCUMENTS

| | | |
|---|---|---|
| 1177536 | 9/1964 | Fed. Rep. of Germany . |
| 1432599 | 2/1966 | France . |
| 2128580 | 10/1972 | France . |
| 2403430 | 4/1979 | France . |
| 8504366 | 10/1985 | PCT Int'l Appl. . |
| 0201041 | 1/1966 | Sweden . |
| 0500082 | 2/1939 | United Kingdom . |
| 1345008 | 1/1971 | United Kingdom . |
| 1579568 | 11/1980 | United Kingdom . |
| 1580589 | 12/1980 | United Kingdom . |

*Primary Examiner*—Werner H. Schroeder
*Assistant Examiner*—Sara M. Current
*Attorney, Agent, or Firm*—Oblon, Spivak, McClelland, Maier & Neustadt

[57] ABSTRACT

Fibrous flakes used to reconstitute heat and sound insulants in the form of felts are themselves produced from a compressed fleece by an opening operation. The flakes detached from the fleece are carried away from the opening device in order to be used immediately.

11 Claims, 3 Drawing Sheets

FORMATION OF MINERAL FIBRE FLAKES AND USE OF THESE FLAKES TO RECONSTITUTE INSULATING MATS

BACKGROUND OF THE INVENTION

1. Field of the Invention

The invention relates to the formation of fibrous flakes and to the use of these flakes of small size to reconstitute heat and sound insulants which take the form of mats or felts of relatively low densities.

2. Background of the Related Art

It is known that in products of the type in question, the insulating, particularly heat insulating, properties are a function of the density of the product and that generally speaking for any mass of fibres, the lower the density, the better is the insulation. It is therefore desirable to use what are referred to as "light" products, that is to products which have a low density.

However, this tendency causes difficulties due to the bulk of these materials. Their volume is a factor which is important in evaluation of their cost. The increased volume considerably increases the costs of storage and transportation.

In practice, the prepared products, felts or mats, are compressed when they are packaged in order to reduce these costs. The possibility of compression is however limited by the ability of the products to resume their properties when the time comes for them to be used. Fibre mats may thus undergo a compression ratio of no more than about 7 under optimum conditions if one wishes to avoid changing their properties.

Even under these compressed conditions, the density of the compressed product remains relatively small. It does not normally exceed 80 kg/cu.m.

Furthermore, insulating products are used in the form of flakes or particles of small size (of around 5 to 30 mm). These flakes are, for example, spread in layers over the floors of attics which are not fitted out, serve to fill cavity walls or may be adhered to walls which have to be insulated.

These flakes are ordinarily formed "in bulk" in the compressed state. In this case, the compression imposed on them normally makes it possible to achieve densities of around 150 kg/cu.m and more.

The flakes originate from various sources, particularly from cut up felts, which constitutes a way of using products which do not comply with the severe specifications existing for felts in this field. But for certain products, flakes are systematically prepared from felts or fibres which at the outset are intended to be used to produce these flakes.

In all cases, the cutting up and the compression employed in packaging profoundly modify the felted structure. After decompression, the product has to undergo a vigorous treatment capable of restoring it to a satisfactorily homogeneous density for it to regain its insulating properties. Traditionally, this treatment comprises a pneumatic expansion operation which, in addition to swelling the flakes, also serves for transportation and distribution of the flakes to the place where they are to be used. Often associated with this pneumatic treatment are carding, opening, loosening up or similar operations.

In practice, it has been found that even with the application of vigorous treatments upon unpacking, the layers of insulants formed by means of these flakes do not have the qualities originally embodied in the felts. To obtain a consistent quality of insulation, it is necessary to substantially increase the mass of fibres used per unit of surface area (this is so even if the apparent density is unchanged). It is not rare to have to double the mass of fibres to obtain comparable performance.

The deterioration in the insulating properties is explained primarily by the effect of the flake formation process. The crushing, chopping or cutting up of the original felts not only leads to shorter flakes but above all leads to a lack of homogeneity in the distribution of the fibres through these flakes. Typically observed is the appearance of denser "nodules" within these flakes. This distribution is unfavourable to the insulating properties and the pneumatic and mechanical swelling of the flakes after decompression does not ordinarily make it possible to restore a distribution of the fibres in the insulant which is comparable with that in the original felt.

In an effort to avoid the faults associated with crushing operations, it has been proposed to "cut up" the original felt to form the flakes. In this way, the structure of these flakes is less altered. This procedure in particular is assumed to make it possible to avoid the previously mentioned lack of homogeneity. Even in this case, it is not possible to fully restore the qualities of the original felts when the time comes to use them. The reason for this difficulty is probably linked to the fact thst the compression of the flakes when they are packaged is carried out without the orientation of the fibres in these flakes in bulk being taken into consideration. In other words, the overall orientation of the fibres is random. The quite substantial compression is not, as in the original felts, exerted according to a direction which tends to respect the preferred orientation of the fibres. The result is an alteration in the structure of these flakes which cannot be fully made up by the subsequent "swelling". This effect is all the more substantial if the fibres constituting the felt are more irregular and therefore more fragile, which in particular characterises the fibres in rock wool.

Despite these drawbacks, the use of flakes for forming insulating layers remains preferable to the use of mats for certain particular uses. This is the case particularly for uses where the geometrical form of the layer to be made up or its location make it difficult to use mats or preconstituted panels.

As we have already seen, the use of mats normally creates restrictions on storage and transport which flakes make it possible to overcome.

SUMMARY OF THE INVENTION

The object of the invention is to furnish insulants formed of fibrous insulating flakes which have improved properties compared with those formed by conventional methods and the characteristics of which are close to those of the original felts or mats, that is to say of the fibrous materials from which the flakes are prepared.

The invention provides these insulants in the form of flakes while retaining or even accentuating the rates of compression of the products for storage and transport in comparison with the conditions currently employed for fibrous flakes in bulk.

According to the invention, the storage and transportation of products are carried out with the products in the form of compressed mats or fleeces prior to formation of the flakes. Such flake formation is postponed to a time when these products are decompressed, a time which is ordinarily the time when they are used.

The process of producing the constituent fibres is of a conventional type. In this process, the fibres produced are conveyed by intense gaseous currents and are deposited on a conveyor in the form of a continuous sheet. In this sheet or fleece, and except where otherwise provided for, the disposition of the fibres is not isotropic. The manner of reception, and in particular the suction applied by the carrier gases through the conveyor, encourages the fibres to be disposed in planes parallel with the grid of the conveyor.

This structure of the fleece is advantageously exploited according to the invention. The compression carried out during packaging is exerted in a direction substantially at a right-angle to the plane of the length of the fibres in the fleece of fibres, which is also the plane in which the fibres are preferably orientated. Under these conditions, even intense compression produces only a very limited change in the characteristics of the actual fibres. It can be assumed that the rate of fibres broken by such compression remains very low.

Furthermore, this compression operation is not limited by considerations of the resumption of thickness of the fleece when the packaging is removed. When the fleece is used in this form after a simple cutting to adjust the insulant to the required dimensions, it is essential that it have regained a satisfactory thickness without any operation other than a simple possible "shaking". Experimentally, as stated previously, the ability to resume thickness quite severely limits the rate of compression which can be applied. In the case of the invention, the formation of flakes which follows the decompression makes it possible to restore to the final material a satisfactory density even when the degree of compression applied might not otherwise permit a sufficient spontaneous resumption of the thickness of the fleece.

Thus, in an embodiment according to the invention, it is possible to compress the fleece of fibres to densities which may attain or exceed 250 kg/cu.m. In practice, the rates of compression applied are more limited by the capacity of the apparatus used for packaging than by considerations relative to the properties of the products prepared from these compressed fleeces. In order not to have recourse to very expensive apparatus, compression is more often than not maintained such that the density of the compressed product does not exceed 300 kg/cu.m. The density according to the invention is preferably greater than 150 kg/cu.m in order to derive maximum benefit from the advantages of high rates of compression. By way of comparison, as we stated earlier, fleeces of which subsequent use involves only a simple resumption of thickness are only compressed to densities which do not normally exceed 80 kg/cu.m.

Independently of the rate of compression applied to them, the fibre fleeces used according to the invention may also be distinguished by the nature or content of additives which they may receive, particularly with regard to texturing or binder products. The role of these latter may indeed prove to be vastly different from that which they fulfill in the products used in the form of fleeces or mats. In such fleeces and mats, the binder introduced even prior to the fibres being received on the conveyor contributes to a great extent to the mechanical properties of the final insulant. Such binder guarantees cohesion and controls dimensional characteristics of the product. The binder content is also an important factor in the resumption of thickness.

For the reason that, according to the invention the fleeces are broken down into the form of flakes of small dimensions, it is evident that their cohesion and mechanical strength do not constitute essential factors for the invention.

Similarly, we have stated, the thickness resumption capacity is no longer a question. For these reasons, the binder content in the fleeces used according to the invention may vary far more widely. If it is preferable to retain a certain binder content for reasons which may be indicated hereinafter, it is also possible to use no binder at all. In this case, there may possibly be a texturing stage, for example to avoid emissions of dust.

The formation of flakes from mats is, according to the invention, carried out by limiting as far as possible any cutting and/or crushing operations which give rise to the previously mentioned lack of homogeneity. If possible, these operations are even entirely excluded from the process according to the invention.

For this process, the fleece or fractions of fleece are subjected to means which tear up the flakes, separating the superposed tufts in the different layers constituting the structure of the fleece. Sliver by sliver separation makes it possible to easily respect the structure of the fibres. Furthermore, the formation of nodules of fibres which systematically accompanies extended crushing operations, in which the flakes formed roll on each other for a prolonged period before evacuation, is avoided.

Separation of fibrous flakes according to the invention may be carried out in various ways. A preferred operation consists of performing an "opening" operation on the fleece to separate the slivers. It should be stressed that, according to the invention, opening differs from that which is encountered in prior art techniques concerning mineral fibre based insulants. In these prior techniques, the opening, generally associated with a pneumatic treatment, is carried out on more or less compact masses of flakes originating from a previous production operation and subjected in the meantime to considerable compression in this form. According to the invention, on the other hand, opening is carried out on the fleece itself.

It is preferable also for the opening to constitute the only mechanical operation undergone by the fleece to detach the flakes from the compressed fleece and for this operation to be as brief as possible to avoid nodules forming.

Of the preferred opening means, rotary brushes fitted with semi-rigid tufts make it possible to obtain quite satisfactory results. In particular, it is advantageous to use a set of counter-rotating brushes between which the fibrous fleece is passed.

Under certain conditions, devices which beat the mat of fleeces will suffice to detach the flakes when the fleece has relatively low cohesion, particularly when this fleece contains very little binder or none at all. However, in this case, to facilitate separation of the flakes and also to limit their size, it may be preferable to combine this separation with a prior cutting up of the fleece into smaller elements, particularly into strips a few centimeters wide.

These methods of forming flakes from a fleece of fibres make it possible to prepare more homogeneous and higher performance products when one considers the flakes or products constituted by means of these flakes and particularly insulating layers prepared on the site of use.

Another considerable advantage linked to the formation of flakes in situ from a continuous fleece is the possibility of regulating the rate of flow of flakes to their applications.

In conventional methods utilizing preconstituted flakes, the regular supply is a difficulty which has not been satisfactorily resolved. Among the methods proposed for controlling such supply are augers, honeycombed riddles—all means which do not make it possible to guarantee complete regularity because they are applied to an insufficiently fluid material. The technique according to the invention, which is based on the use of a fleece of fibres does, on the other hand, permit satisfactory regularity. The means used for forming the fleeces of fibres are well controlled so that one knows how to prepare fleeces which offer quite considerable regularity, particularly with regard to the mass of fibres per unit of surface area or, which is equivalent, per unit of length of fleece. Starting with a regular fleece, conveyance at a constant speed into flake-forming means makes it possible to guarantee quite considerable regularity in the rate of flow of flakes.

This regularity of the technique according to the invention in the supplying of flakes is quite appreciable when an insulating element is reconstituted and calls for specific quantities of fibres. For certain applications, this regularity may even be vital.

Among these applications, the invention is concerned particularly with the production of prefabricated building elements which combine a rigid support such as panels or box sections, with a regular covering of insulating material.

A particularly developed type of element of this sort consists of trough-shaped box sections comprising one or a plurality of compartments, used as prefabricated elements to form roofing timbers. More usually, these box sections are composed of a panel of agglomerated wood particles forming the bottom of the box section and at least two rafters fixed on the bottom panel. The insulating material is disposed between the rsfters. The dimensions and the rates of industrial production of these elements are such that the positioning of a strip of preconstituted insulating felt is difficult. For this reason, at the present time, the choice of insulating material used has tended towards compounds of the synthetic foam type, particularly polyurethane foams which are constituted in the box section itself by injection of a mixture which expands and becomes stabilized in the form of a regular layer which adheres strongly to the support. The relative ease of using these materials does, however, have in counterpart the disadvantage of high cost in comparison with that of mineral fibre based insulating materials.

The novel techniques according to the invention make it possible to reconstitute insulating layers under conditions which lend themselves particularly well to the production of such elements, and even to control the technique of reconstituting this insulant from flakes.

Indeed, as indicated previously, the conventional methods of using insulating fibrous particles consisted of spreading these particles over the surface to be insulated or filling cavity walls, conveying particles to the point of use by means of a powerful flow of gas, ordinarily the same as was used for expanding the compressed particles. Under these conditions, it is not easy to contain these particles within the box section which it is desired to provide with an insulating layer.

By constituting the flakes according to the invention without having recourse to the use of a flow of gas, the box sections may be filled simply by gravity. The flakes are formed in the apparatus which detaches them from the fibrous fleece immediately above the box section filling assembly.

Advantageously, a procedure is adopted whereby the box sections to be filled circulate continuously under the flake supply and the rates of passage of these box sections and that of the fibrous fleece from which the are drawn are made to coincide. In this way, the rate of flow of flakes is adjusted precisely to the rhythm with which the box sections are produced. Thus a high regularity of filling and quite specific insulating properties can be guaranteed.

In this type of application, the reconstituting of the insulating layer requires the use of a binder capable of fixing the flakes to one another. When this binder is deposited on the fibres in liquid form, it is preferable to proceed as far as possible on the path followed by the flakes to avoid any risk of dirtying by premature gluing of the flakes on the walls routing the flow. The application of binder or glue is therefore carried out as close as possible to the place where the flakes are collected.

For the example of application envisaged, this corresponds to a position situated immediately above the box sections which are to be lined. To obtain a relatively regular coating while avoiding upsetting the flow of flakes, it is advantageous to use sprayers which are not air operated.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBOIDMENTS

Figure 1:
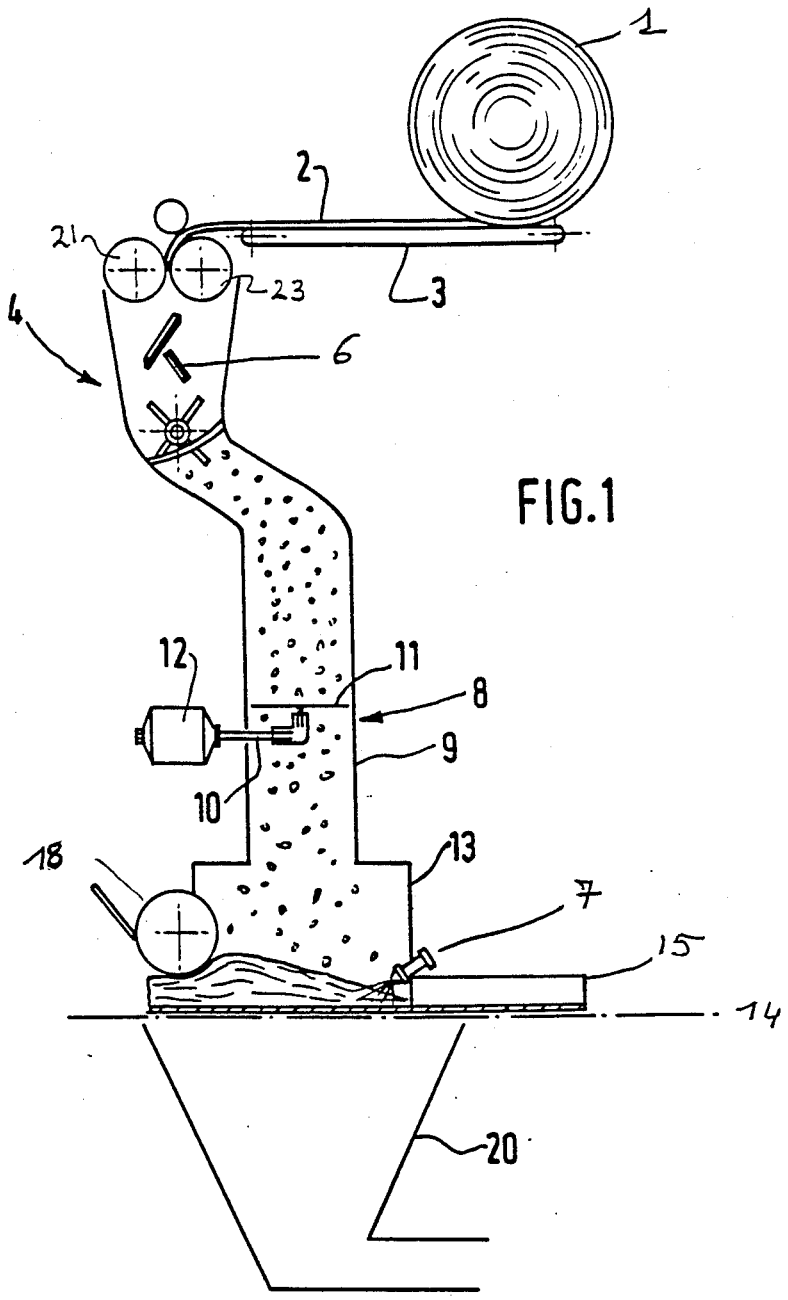
FIG. 1 is an overall view showing in section a plant for the regular formation of flakes from a compressed fleece and the reconstitution of an insulant from these flakes.

In the procedure illustrated in FIG. 1, the fibrous material used takes the form of a roll 1 which may be highly compressed. The roll 1 is placed in an unrolling device, not shown.

The fleece of fibres 2 drawn from the roll 1 is carried to the flake-forming assembly by a conveyor 3.

The various layers of the fleece forming the roll being quite considerably compressed on one another, the fibres in contiguous layers have a tendency to overlap and stick to one another. A certain traction is thus needed in order to detach the fleece from the roll. It is for this reason that it is preferable to make up these rolls from felts to which a binder has been applied to impart a certain cohesion to the fleece. However, the cohesion necessary at this stage is relatively limited and therefore the binder content of the initial felt may be substantially less than that of the insulants used directly in the form of fleeces or mats (i.e., those made without passing through the flake-forming stage).

To detach the fleece 2 from the roll 1, the latter is, for example, subjected to intense local suction. This may be obtained by disposing a suction box (not shown) immediately below the conveyor 3.

Figure 3:
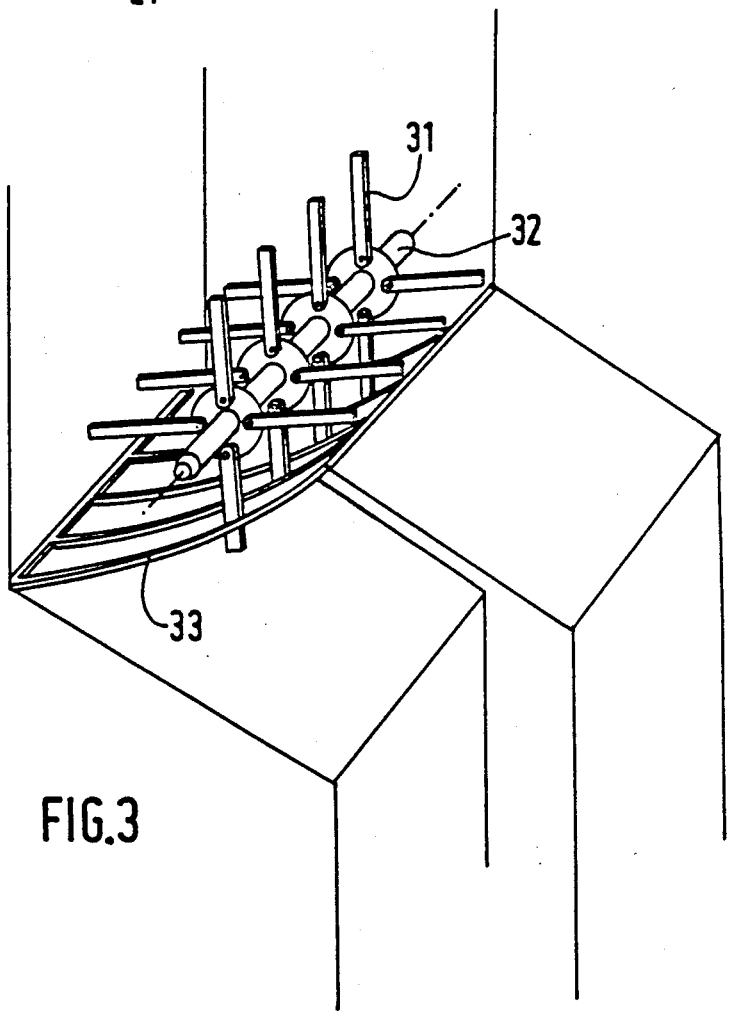
FIG. 3 shows in aperspective view a device for forming flakes according to the invention.

The flake-forming assembly which is generally designated 4 consists mainly of a device of the type shown in FIG. 3 mounted in duct 9. It comprises an assembly of rotary flails 31 articulated on a shaft 32. This device includes a grille 33 between the bars of which the flails 31 are free to rotate. The device includes one or a plurality of sets of flails 31. The flakes detached from the fleece by the flails are immediately evacuated.

For reasons indicated above, it is important to the quality of the flakes to restrict the dwell time of the fibrous material in this apparatus which performs a vigorous treatment.

The dimensional characteristics of the grille and of the flails control the dimensions of the flakes at the exit from this apparatus.

Figure 2:
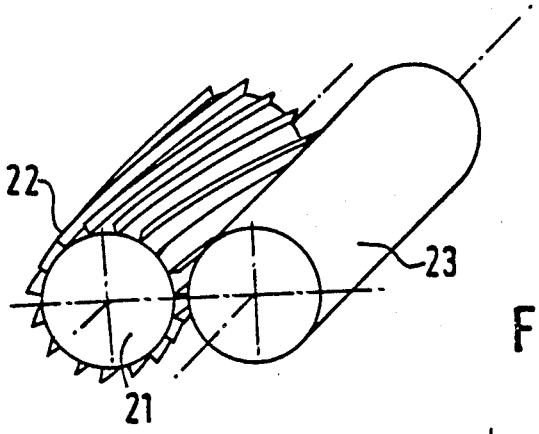
FIG. 2 shows in a perspective view a device for cutting the fleece of compressed fibres.

The flails 31 strike the fibrous material and tear away the flakes from which it is constituted. When the cohesion of the fibres is relatively strong, for example when a high binder content renders the tufts strongly attched to one another or when an extensive intermingling of the fibres renders separation of the flakes more difficult, it is possible to combine with the process a device 5 such as is shown in FIG. 2. The function of the device in FIG. 2 is to reduce the fibrous fleece 2 into elements of small dimensions, facilitating the subsequent operation of flake separation which has been referred to above. The use of such an apparatus makes it possible to keep the processing time extremely short.

In the embodiment of the drawings, the fleece 2 is first cut into transverse strips 6 (in relation to the unrolling direction of the strip). This cutting is carried out by passing the fleece of fibres 2 between a cylinder 21 on which there are cutters 22 and a counter cylinder 23 on which the fleece of fibres is pressed by the cutters.

The width of the strips 6 is determined by the distance separating two successive cutters on the cylinder 21. This width is chosen according to the dimension of the flakes to be produced. It is no less than that of the flakes and is preferably between 2 and 5 times this dimension.

The cutting operation which is carried out in this way does not change the properties of the flakes, which are then detached as they would be by a prolonged crushing. Even if a limited proportion of fibres may be broken, the homogeneity of texture is not changed by this cutting.

By way of example, a fleece of fibres compressed to 200 kg/cu.m and 1.20 m wide is used. The unrolled fleece has a thickness of approx. 30 mm. It is passed between the cutter carrying cylinder 21 and the counter cylinder 23. The blades of the cutters are 15 mm high and are spaced apart from one another by 40 mm. The blades are disposed according to the generatrices of the cylinder or are slightly inclined in relation to these latter.

It is interesting to note that the blades do not have suficient height to section the fleece over its entire thickness. In other words, the blades do not come in contact with the counter cylinder 23. Nevertheless, the pressure exerted on the fleece by the blade and the local deformation produce a complete break away of each strip.

The felt elements cut into strips are taken up by the flails 31 disposed in groups of four on the shaft 32. Each group of flails is 80 mm remote from the adjacent group in the axial direction of the shaft. The flails are approximately 150 mm long. The bars of the grille 33 are 50 mm apart from one another.

In one example the speed of rotation of the flails is maintained at 1500 revolutions per minute. The fibrous fleece 2 is introduced into the above apparatus at the rate of approximately 500 kg/hr. In this way, homogeneous fibrous flakes are obtained which have a density of around 30 kg/cu.m and the dimensions of which are approximately 15 to 20 mm.

If necessary, the flakes formed according to the invention are subjected to a treatment which makes it possible to adjust their density to the needs corresponding to the envisaged use. The previously described process, while it makes it possible to separate the flakes, is not always sufficient to give them the desired "lightness". In other words, these very homogeneous flakes have not always resumed a density close to that of the fleece of fibres prior to its being rolled up.

To accentuate the resumption of volume of these flakes, it is possible to use conventional pneumatic means. According to the invention, when transportation of flakes is not necessary, it is preferred to have recourse to mechanical means which make it possible to avoid the subsequent separation of flakes from gas.

To avoid any discontinuity in the conveyance of flakes which might give rise to a difficulty in maintenance of an even and homogenous circulation, this treatment is performed directly on the flakes while they are falling from the outlet from the flake-forming apparatus.

An advantageous procedure according to the invention lies in disposing in the duct 9 an assembly 8 carrying rotating whips 11 formed from flexible steel wires and which sweep the entire cross-section of the duct. These whips rotate at high speed and, striking the flakes, encourage the relaxation of stresses imposed upon them during compression at the packaging stage.

To avoid the accumulation of particles on the arms 10 which transmit rotational power to the whips 11, it is preferable to dispose these whips immediately upstream of the arm 10. If necessary, a plurality of groups of whips 11 may be disposed in the path of the flakes. In particular, it is possible with a single assembly 12 and a single arm 10, to actuate a group of whips upstream of the arm 10 and a second group (not shown) situated downstream of this same arm. In this latter case, to retain the full effect of the impact on the flakes, it is preferable to have the whips 11 rotate in opposite directions to each other.

By carrying out this treatment by using, for example, two strands 3 mm in diameter rotating at 5000 r.p.m. on the flakes formed under the previously described conditions, a product having a density of 5 kg/cu.m is obtained. In other words, the lightening of the flakes produced by these mechanical means makes it possible to considerably reduce the density.

Figure 4:
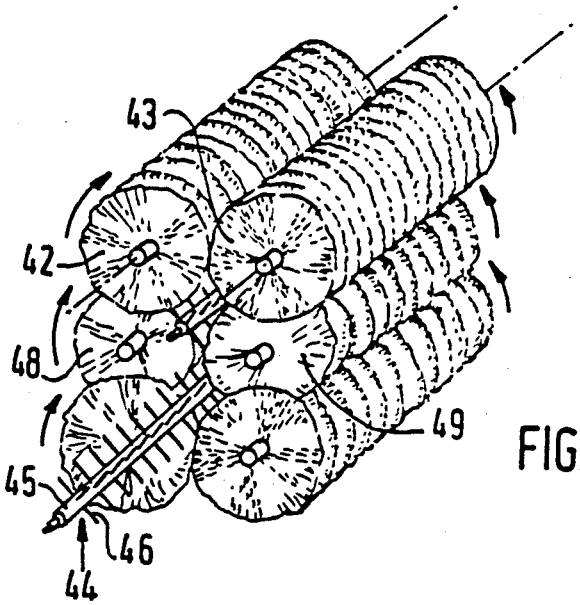
FIG. 4 shows another method of flake formation according to the invention.

Another method of forming flakes according to the invention, which would replace the flail arrangement 4 in duct 9, is shown in FIG. 4. The apparatus used for this method of formation consists of a series of rotating brushes associated in pairs and designated 42-43, 48-49.

These brushes are provided with semi-rigid bristles of a relatively hard synthetic material, for instance, so that they can for an acceptable time withstand abrasion from contact with the fibres. For instance, polyamide bristles may be used which have a cross-section of around 1 to 2 sq.mm.

Advantageously, the strands or bristles are disposed on the shaft which carries them in a helical or disc arrangement, the distance separating two consecutive discs or the pitch of the helix being preferably less than four times the dimension of the flakes to be detached.

Preferably, the brushes of each pair of brushes are so disposed that the bristles are tangent or intersect each other over a short length. This latter arrangement is preferred when the bristles are disposed in "discs" and the discs of a brush are offset in relation to those of the corresponding brush which is opposite it.

The fleece of fibres is passed between the brushes 42 and 43 which are rotated in directions indicated by the arrows in the drawing. The direction of rotation is such that the fleece is pulled between the two brushes.

The apparatus includes at least two pairs of brushes which successively snatch at the fleece and detach the flakes from it.

As a general rule, the assembly comprises no more than four pairs of brushes. Their number is, of course, a function of the vigour of the treatment to be used to pull away the flakes, and the thickness of the fleece which is being treated.

It is preferable to dispose the pairs of successive brushes in such a way that their bristles intersect over a considerable fraction of their length. This feature may be provided by use of brushes arranged in oppositely oriented helices or in the form of a disc. This arrangement favours self-cleaning of the brushes by one another, any fibres likely to remain clinging to a brush being automatically "extracted" by the previous or subsequent brush with which its bristles intersect. For this, it goes without saying that all superposed brushes must rotate in the same direction.

Between each pair of brushes it is also possible advantageously to dispose an element which serves as a comb, making it possible to detach the fibres which might remain clinging to the brushes. A comb 44 is shown partially extracted from the apparatus in FIG. 4. It consists of a fixed rod 45 carrying a multiplicity of teeth 46. In its working position, this comb is situated, for example, in the space defined by the four brushes 42-43, 48-49.

Used under the conditions of the previous example, the assembly shown in FIG. 4 made it possible to prepare very homogeneous fibrous flakes and the formation of an insulating mat from these flakes, of which the density was approximately 15 kg/cu.m.

The speed of introduction of the fleece 2 into the apparatus will in any case determine the rate of flow of flakes produced. Modification of this speed therefore makes it possible to vary the rate of flow, but above all a constant speed of introduction makes it possible to have a very stable flow of fibres. This property is exploited in the reconstitution of insulating mats.

One application of this technique is shown in FIG. 1. The flakes which have been prepared as indicated previously fall through the duct 9 into a hood 13 disposed over a conveyor 14 on which trough-shaped building elements 15 are circulating.

The configuration of the hood 13 depends on the distribution of flakes which it is desired to achieve. In the case illustrated, the width of the hood is that of the element 15 which has to be filled with fibres. The sides 16 of the hood (shown in FIG. 5) are adjusted in such a way as to be aligned with the lateral uprights 17 of the element 15 and over the face thereof which is on the inside of the trough so that the flakes are entirely carried in the element 15.

On the upstream side, in the direction of travel of the elements 15, the hood has a sufficient opening above the conveyor to allow the elements to pass. On the downstream side the hood is closed by a wall 19 and a rotatable roller 18, the peripheral speed of which corresponds to that at which the elements 15 are passing.

The roller 18 is disposed in such a way as to be flush with the top part of the uprights 17.

Inside the hook are spray means such as are indicated at 7 (FIG. 1) can apply a binding solution.

Figure 5:
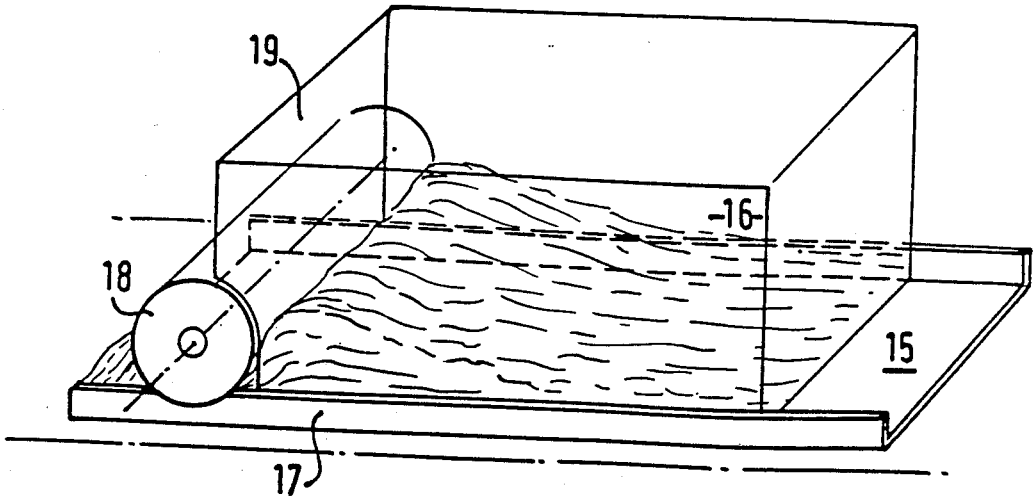
FIG. 5 is a perspective view of the base of the assembly in FIG. 1.

Operation of the installation in FIGS. 1 and 5 is as follows.

Under their own weight, the flakes fall into the element 15. They are maintained during their fall by the sides 16. It is necessary to so channel them properly by virtue of their lightness, and also possibly the effect of rotation of the flakes which may result from the movement of the whips 11.

It is likewise necessary to firm-up the flakes insofar as, under the effect of their weight, they are deposited in a very light mass. Prior to this firming, which is carried out by means of the roller 18, the mass has a thickness which exceeds the height of the uprights 17. Therefore, it must be contained.

The absence of any pneumatic transport for the flakes favours a non-turbulent depositing of flakes. In order not to upset this situation, it is desirable to use non-pneumatic sprays for applying the glue.

To avoid any risk of dirtying the duct carrying the flakes, the binder is sprayed on in the immediate vicinity of, and preferably partly over, the element 15.

For example, the bottom of the element 15 can be sprayed by a first jet 7 so that the flakes which are in contact therewith are caused to adhere to it. This spraying is carried out when the element enters the hood. One or a plurality of other spray jets (not shown) disposed at various points in the hood, preferably likewise directed towards the element 15, coat the flakes as and when they are deposited therein.

The layer of coated fibres formed on the element is firmed by passing under the roller 18 so that the insulating layer is flush with the level of the uprights 17.

In gluing the fibres, it is advantageous to use a , self cross-linking composition so that the coated panels do not require any further treatment.

The binder introduced may also be applied in solid form. In this case, a fine powder is dispersed over the flakes. To obtain an excellent dispersion, it is advantageous to introduce the powder upstream or at the level of the flake forming apparatus 4, which ensures satisfactory penetration of the fibrous mass with no risk of making the apparatus dirty.

If necessary, a film may also be deposited on the element 15 so as to cover the layer of fibres.

The assembly referred to hereinabove operates continuously. The elements 15 are positioned end-to-end and all the flakes are normally collected. For any discontinuity and for any starting and stopping, a recovery box 20 is disposed opposite the hood. Fibres which are not used are collected and may, if necessary, be recycled.

The foregoing description relates to an element 15 which comprises only one longitudinal compartment. In practice, such elements comprise two or three compartments. It goes without saying that a plurality of assemblies may be disposed side by side in order to simultaneously fill each of these compartments.

To this end, a roll of compressed fibrous fleece may be divided longitudinally into as many partial strips as there are compartments to be filled. Longitudinal cutting, for example by means of conventional circular saws, also makes it possible to distribute the quantity of fibres directed to each compartment according to the respective transverse dimensions of these compartments. For this, it is sufficient to form strips the width of which is proportion to that of the compartment to be filled.

It is also possible to supply each of the different assemblies from separate rolls.

By way of example, elements 15 comprising two compartments 500 mm wide have been covered with a felt reconstituted according to the invention.

Supply was from rolls weighing 50 kg and compressed to 300 kg/cu.m, forming a fleece 1.20 m wide.

This fleece was divided into two equal parts directed to two apparatuses of the type shown in FIG. 1, located in parallel.

The rate of supply was 500 kg/hr.

Thus an insulating covering 90 mm thick was formed, with a density approximately equal to 15 kg/cu.m after calendering by the roller 18.

The measurements carried out demonstrated excellent regularity of the insulating layer which had thus been reconstituted.

Measurements of thermal resistance of the insulating layers obtained in the manner described previously and by using wool blown in the conventional manner by pneumatic means make it possible to demonstrate the advantages of the invention. In both cases, the original fibrous materials were the same but the subsequent treatment differed, particularly with regard to formation of the flakes.

For instance, the thermal conductivity of an insulating reconstituted layer 90 mm thick and with a density of 15 kg/cu.m has, according to the invention, a thermal conductivity of 40 mW/m° K. A similar layer constituted with blown wool had a conductivity of 48 mW/m° K.

The insulating layer according to the invention is therefore substantially more efficient for the same fibrous mass distributed over the same thickness. This reflects the improvement in homogeneity of insulants which are thus constituted.

This same improvement may also be expressed differently. Thus, to obtain the same thermal conductivity (with the same thickness of 90 mm) of 40 mW/m° K, it is necessary to constitute an insulating layer of traditional blown wool of which the density is approximately 25 kg/cu.m (instead of 15 kg/cu.m according to the invention).

Obviously, numerous modifications and variations of the present invention are possible in light of the above teachings. It is therefore to be understood that within the scope of the appended claims, the invention may be practiced otherwise than as specifically described herein.

What is claimed as new and desired to be secure by Letters Patent of the United States is:

1. A method of forming an insulating layer from a mat of compressed fibrous fleece, comprising the steps of:

forming flakes of fibrous material from a mat of compressed fibrous fleece by an opening type operation;

immediately discharging the formed flakes from the opening operation; and constituting an insulating layer using said discharged flakes.

2. The method of claim 1 wherein said forming step comprises passing the compressed fibrous fleece between pairs of counter-rotating brushes.

3. The method of claim 2 including cleaning said brushes by combs disposed between successive pairs of said brushes.

4. The method of claim 1 wherein said forming step comprises beating the compressed fibrous fleece with rotary flails.

5. The method of claim 1 including the step of cutting compressed fibrous fleece from the mat into strips, prior to said forming step, said strips having a length no greater than five times that of the flakes to be formed.

6. The method of claim 1 wherein the compressed fibrous fleece has a density of at least 150 kg/cu.m.

7. The method of claim 1 including the step of releasing residual compression stresses in said flakes, between said discharging and constituting steps, said releasing step comprising subjecting said flakes to the action of a whip while said flakes are free falling under the effect of gravity.

8. The method of claim 1 wherein said constituting step comprises permitting said flakes to fall by gravity onto a support element on which they may constitute an insulating layer.

9. The method of claim 8 wherein said constituting step further comprises:

permitting said flakes to fall by gravity into a hood;

passing at least one support element in the form of a trough shape box member beneath said hood at a constant speed; and using a roller to firm-up and even-out the flakes constituting the insulating layer on the support element.

10. The method of claim 9 including the step of using a non-pneumatic spray means to deposit a binder on said flakes on said support element.

11. The method of claim 10 wherein said binder is a self crosslinking binder.

* * * * *